United States Patent [19]

Feuz

[11] Patent Number: 4,926,754

[45] Date of Patent: May 22, 1990

[54] CABLE WAY FOR SUSPENDED VEHICLES

[75] Inventor: Fritz Feuz, Thun, Switzerland

[73] Assignee: Von Roll Transportsysteme AG, Thun, Switzerland

[21] Appl. No.: 309,348

[22] Filed: Feb. 10, 1989

[30] Foreign Application Priority Data

Feb. 10, 1988 [CH] Switzerland ..... 00472/88

[51] Int. Cl.[5] ..... B61B 7/02

[52] U.S. Cl. ..... 104/112; 104/111; 104/115; 104/202; 104/214; 105/148

[58] Field of Search ..... 104/112, 115, 123, 192, 104/173.2, 182, 189, 202, 209, 214, 87, 111, 91, 93, 172.4, 173.1, 173.2, 197, 215; 105/148, 150, 149.1, 146

[56] References Cited

U.S. PATENT DOCUMENTS

| | | | |
|---|---|---|---|
| 972,509 | 10/1910 | Cooney | 104/192 |
| 2,608,161 | 8/1952 | Wallmannsberger | 104/209 |
| 3,394,661 | 7/1968 | Muller | 104/202 |
| 3,557,706 | 1/1971 | Maurer | 104/173.2 |
| 4,665,755 | 5/1987 | Stalder | 104/209 |

FOREIGN PATENT DOCUMENTS

| | | | |
|---|---|---|---|
| 207892 | 3/1960 | Austria . | |
| 0073935 | 8/1982 | European Pat. Off. . | |
| 0534220 | 10/1930 | Fed. Rep. of Germany | 104/115 |
| 0655711 | 1/1938 | Fed. Rep. of Germany | 104/112 |
| 2419898 | 11/1979 | France | 104/173.2 |
| 0033450 | 3/1979 | Japan | 104/112 |
| 405388 | 7/1966 | Switzerland . | |
| 429811 | 8/1967 | Switzerland | 104/209 |

*Primary Examiner*—Andres Kashnikow
*Assistant Examiner*—Mark T. Le
*Attorney, Agent, or Firm*—Toren, McGeady & Associates

[57] ABSTRACT

A cable way for transporting suspended vehicles or cars includes a moving pulling cable and a guide element defining a long travel axis and formed at least in part as a support cable. The cable way at certain locations is adjustable in height and to both sides along the long travel axis. At the certain locations, the support cable is replaced by rigid rails. Each vehicle is supported on the guide element by a roller mechanism including a grip secured to the pulling cable with the grip connected by an articulated rocker member to travel rollers contacting the guide element. The rocker mechanism includes two guiding or steering elements pivotally displaceable relative to the long travel axis for effecting the adjustment at the certain locations. The grip generally engages the pulling cable from below and permits travel over diversion rollers located on both sides of the pulling cable. Changes in position and spacing between the pulling cable and the guide element can be effected at the adjustable locations due to the mobility of the grip. The travel path of the guide element can be freely selected for adaptation to existing terrain conditions.

14 Claims, 5 Drawing Sheets

CABLE WAY FOR SUSPENDED VEHICLES

BACKGROUND OF THE INVENTION

The present invention is directed to a cable haulage apparatus or cable transport system for forming a travel path for vehicles or cars, and includes a pulling cable, a guide element, vehicles or cars, and means for securing the vehicles, travelling along the guide element to the pulling cable.

Cable conveying installations of the above type are known as haulage lifts. Further, chair lifts and suspended car conveyors designed as single cable conveyors are known where the chairs or cars are guided in stations in a coupled state with the cables, and with horizontal displacement from the exit side to the entrance side. A diversion of the conveying track to both sides is impossible, quite apart from the fact that the single side diversion occurs only in the unloaded state of the chairs or cars. It represents, however, an important restriction in that the conveying track traversed under load must run along a straight line and displacement toward one side is possible only by subdivision into several segments.

SUMMARY OF THE INVENTION

Therefore, it is the primary object of the present invention to provide a secure cable way permitting optimum adaptation of the travel path to the terrain by affording displacement for both sides as well as in height.

In accordance with the present invention, the track or guide member defining the path of travel of the vehicle has a long travel axis including rigid curved sections at certain locations. The pulling cable extends along and is spaced from the guide member. The vehicles are secured to the pulling cable by roller mechanisms, each having travel rollers in rolling contact with the guide element along the long travel axis. Each of the roller mechanisms includes a grip secured to the pulling cable which is rigid in the direction of the long travel axis and is displaceable in a plane extending transversely of the long travel axis. Since the relative position between the guide member and the pulling cable can be changed within the conveying distance without any interference by a predetermined clamping position, the cable way of the present invention permits adaptation to the conveying or travel path in an optimum manner with regard to the specific prevailing conditions, such as terrain conditions, by appropriate lateral displacement to both sides along the path of travel. The ability to adapt to existing conditions is of increasing importance, for instance, for avoiding any undesirable impingements on existing natural features. With the mobility of the grip relative to the roller mechanism, it is possible to impart forward forces to the roller mechanism and to avoid the pulling cable from influencing the position of the roller mechanism relative to the guide member by way of the grip, or that the grip is stressed by corresponding forces.

While it is possible to arrange the grip for spacing changes, so that, for instance it can be displaceable in a straight line in a guide member or articulated member formed on the roller mechanism and pivoted around an axis parallel to the long travel axis of the vehicle, a preferred embodiment of the invention involves the guidance of the grip by a pair of links or guide bars along a path determined by the guide bars. It is possible to determine the course of the travel path by an appropriate arrangement of the guide bars for combining the change in spacing with a controlled transverse movement of the grip with such displacements being effected within a plane extending transversely of the long travel axis. If the grip can be used to connect vehicles with the pulling cable or to disconnect the vehicles during the movement of the pulling cable, the course of the path of the grip in the open state can facilitate the approach to the pulling cable or its movement away from the cable.

Depending on the specific use or purpose of the cable way, the position of the pulling cable can be selected to extend above or below the guide member. In a normal operating position, the grips extend along straight path sections, essentially downwardly or upwardly. Accordingly, the grips can follow a lateral offset of the pulling cable relative to the guide element by a pivoting action and effecting passage of the cable rollers enabling displacement on curves so that lateral displacement relative to the pulling cable is not obstructed. Preferably, the guide member is formed by one or two support cables and in curved sections by rails where the installation, according to the invention, is used as a suspended cable way.

The cable way, according to the present invention, can be constructed as a funicular railway in which apart from a rail forming the guide element, an additional rail can be used as a support member. In such an arrangement, the pulling cable can extend approximately at the same level as the rail or the rails and grips can extend downwardly from the roller mechanism to the pulling cable. In such an arrangement, the mobility of the grip relative to the roller mechanism enables lateral displacement of path sections which permit different slopes and displacements laterally to both sides.

If only a single guide member is provided and the spacing between the pulling cable and the guide element is to be kept small, the arrangement of the mobile guidance of the grip at the roller mechanism assumes particular importance.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawing, a moving car cable way is shown as follows.

DETAILED DESCRIPTION OF THE INVENTION

Figure 1:
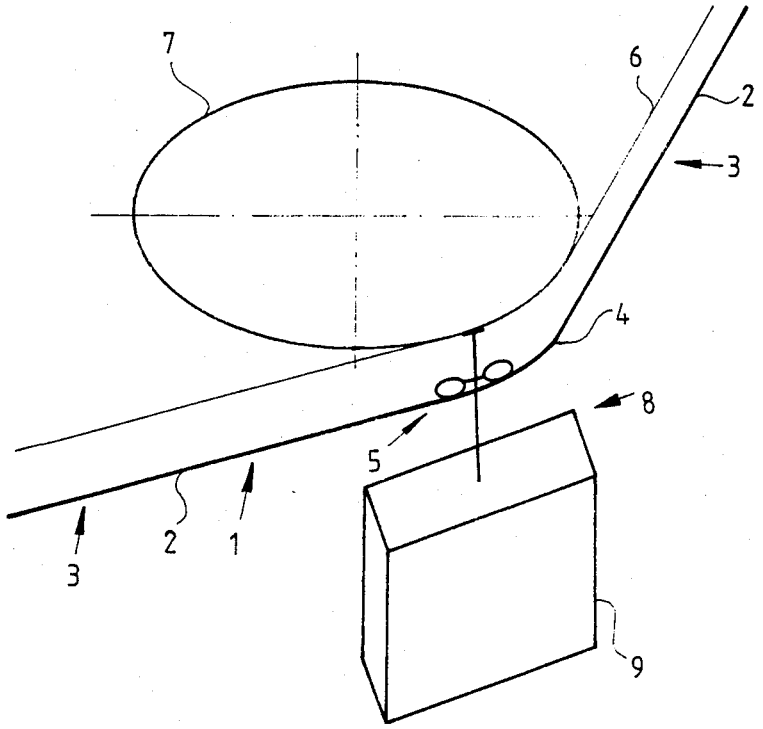
FIG. 1 is a schematic illustration in perspective of a curved travel path section.

In FIG. 1, a track or guide member 1 acts as a support member and is made up of support cables 2, forming straight sections 3, and rigid rails 4, forming curved sections 5. The combination of the straight sections 3 and the curved sections 5 define the travel path of the cable way. A traction or pulling cable 6 is spaced upwardly from the guide member 1, and runs over cable rollers 7, only one is shown, and extends along the path of the guide element. A vehicle 8 comprising a suspended car 9 is secured to the pulling cable 6 by a grip 10, note FIG. 3, in a manner to be explained subsequently.

Figure 2:
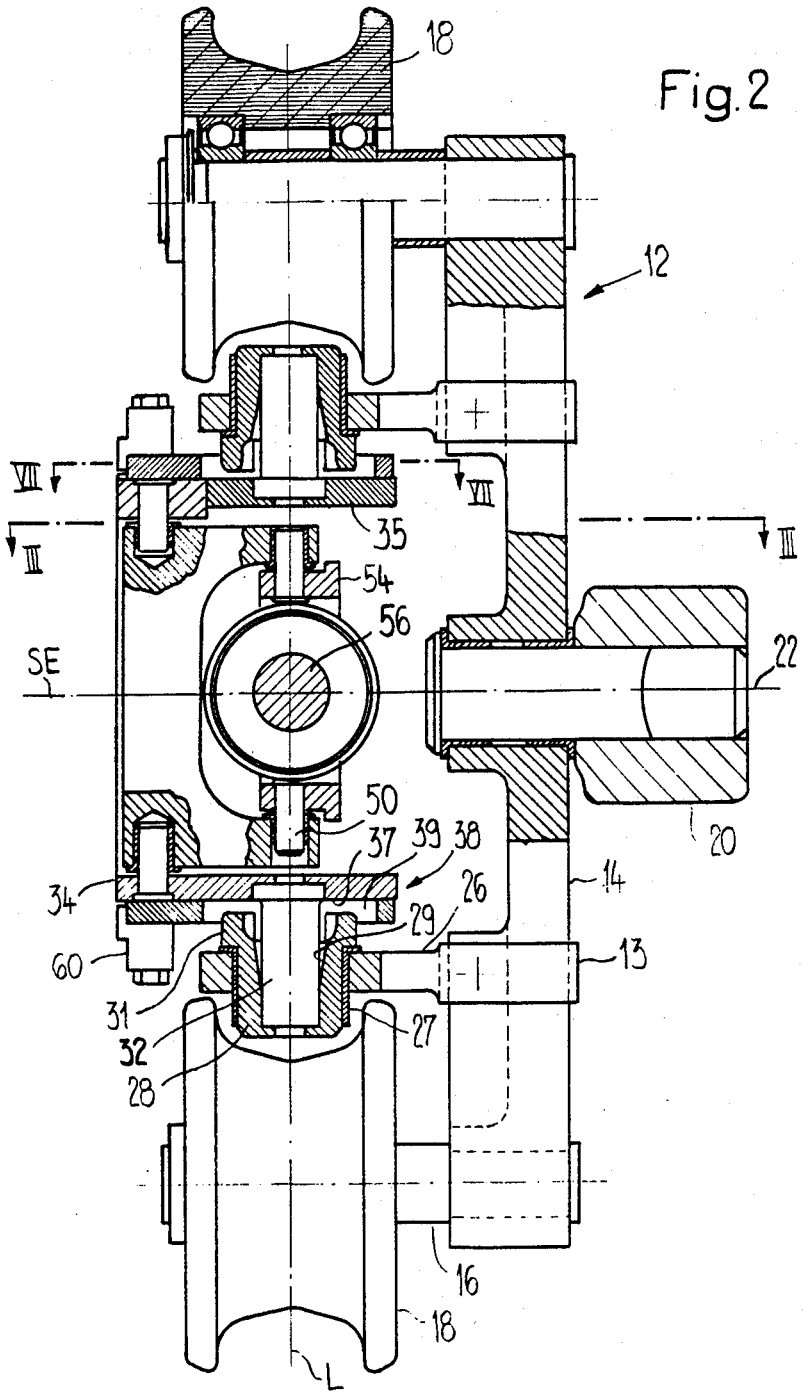
FIG. 2 is a horizontal section through a roller mechanism.

Vehicle 8 has a travelling or roller mechanism 12, note FIG. 2, including a beam 14 forming part of roller mechanism frame 13. Travelling rollers 18 are each supported on spaced parallel axle journals 16 extending outwardly from the beam 14. Roller mechanism 12 is supported and guided by the rollers 18 on the guide member 1. Suspension tackle 20 supporting the car 9, is pivotally mounted in the beam 14 by a suspension tackle lug 22 disposed parallel to the axle journals 16.

L designates a long travel axis of the roller mechanism 12, located somewhat above the axle journals 16. Two bearing brackets 26, forming a part of the roller mechanism frame 13, are fastened on the carrier or beam 14 between the two axle journals 16. Each bracket 26 supports a bearing bush 27, spaced laterally from the beam 14, and the bearing bushes are coaxial with the long travel axis L. Each bearing bush 27 contains a bearing member 28, rotatable within it. Bearing member 28 has a bore 29 containing a dampening lug 32 of flexually-elastically deformable material with the dampening lug being capable of bending deformation to a limited extent. Each dampening lug 32 is attached to a leg 35 of a U-shaped articulated rocker 34, forming an articulation member. Each of the legs 35 forms a sliding guide 38 at the side 37, facing the corresponding bearing bracket 26. Each sliding guide 38 has an elongated guidance aperture 39, into which the flattened end 31 of the corresponding bearing member 28, facing the guidance aperture, engages so as to be displaced laterally relative to the axis L. Articulated rocker 34 is pivotally mounted around the long travel axis L of the roller mechanism 12 in the combination of the bearing bushes 27 and the bearing members 28 and, in addition, the sliding guides 38, permit displacement limited corresponding to the dimensions of the sliding guides, of the articulated roller relative to the bearing members, that is, transversely of the long travel axis L. Such movements occur, however, only against the deformation resistance of the dampening lugs 32, the significance of these lugs will be discussed later.

Figure 3:
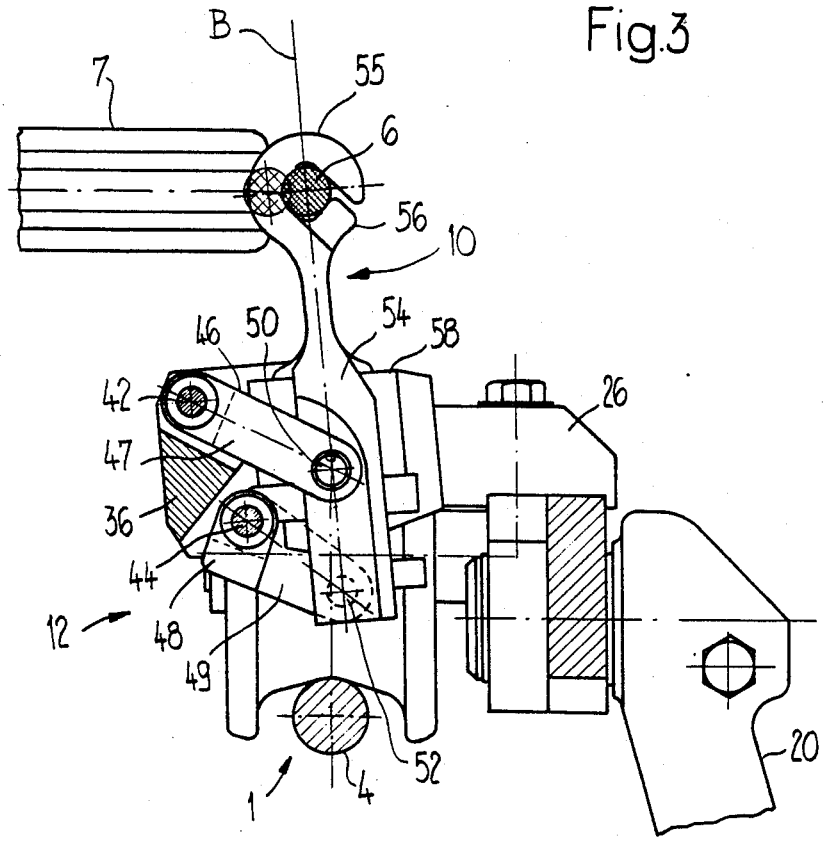
FIG. 3 is a vertical section taken along the lines III—III in FIG. 2.

As shown in FIG. 3, guiding or steering members 46, 48 are pivotally supported in the articulated rocker 34 by pairs of bearing bolts 42, 44 parallel to one another. The link or guiding members 46, 48 are secured in an articulated manner by bearing bolts 50, 52 to a gripping member 54 of the grip 10. While the lower link or guide member 48, as viewed in FIG. 3, is formed of only one guide arm 49, for connection with the gripping member 54, the upper guide member 46 is formed of two guide arms 47 overlapping the opposite sides of the gripping member 54 in a fork-like manner so that the guide member 46 engages both sides of the gripping member 54. It should also be possible to form the guide member 48 of two guide arms connected with the gripping member 54 in the same manner as the guide member 46. The guide members 46, 48 afford a guided displacement of the gripping member 54 or of the grip 10 itself, within the articulated rocker 34. At its upper end, as viewed in FIG. 3, gripping member 54 has a gripping jaw 55 rigidly connected with it and containing another gripping jaw 56, note FIG. 4, displaceably guided in the gripping member. Gripping jaw 56 is retained in position gripping the pulling cable 6, by a cup spring 59, supported in the gripping member 54. In the event of a displacement of the articulated rocker 34, the grip 10 follows with its gripping jaws 55, 56 along a path B defined by the effective length of the guide arms 47, 49 as well as by the spacing of the bearing bolts 42, 44 or 50, 52 from each other. In the illustrated arrangement, link or guide arms 47 are longer than the guide arm 49 and the axes of the bearing bolts 42, 44 are spaced further from one another than are the axes of the bearing bolts 50, 52.

The bearing bracket 26 includes stop lugs not shown, offset by approximately 180° for limiting the pivoting angle of the articulated rocker 34 around the long travel axis L by means of stop lugs 60, attached at the end sides of the rocker. In any case, the grip 10 describes an imagined circularly annular surface in a plane SE, note FIG. 2, extending transversely of the long travel axis L, whose size determines the extent of the permissible different relative positions between the guide element 1 and the pulling cable 6, along the travel path.

It is assumed in the illustrated moving suspended car cable way, that the vehicles 8 are permanently connected to the pulling cable 6 by the grips 10. This presupposes an appropriately low cable velocity, if the moving suspended cable way is utilized for the transportation of personnel, for enabling the personnel to enter and exit in the stations.

As can be clearly noted in FIG. 4, grip 10 engages the pulling cable 6 from below and, when travelling over displacements in the travel path, enables lateral displacement to one side or the other, that is, when travelling over curved sections of the travel path, unimpeded passage at the required cable guidance members is possible, such as the cable rollers 7. Such lateral displacements can occur along a straight section or a curved section in longitudinal profile, and along a curved section, displacement in height can also take place. In the last mentioned instance, the guidance of the pulling cable can be easily arranged by an appropriate transverse slope of the cable roller or the plane of the roller assemblies. If in the course of such movement, the pulling cable has to be conducted in an elevated manner, the unimpeded passage of the grips at the cable roller or of the roller assemblies can be achieved in a simple manner due to the described mobility of the grips 10 and by affording a temporary pivoting of the grips in the plane SE.

Figure 5:
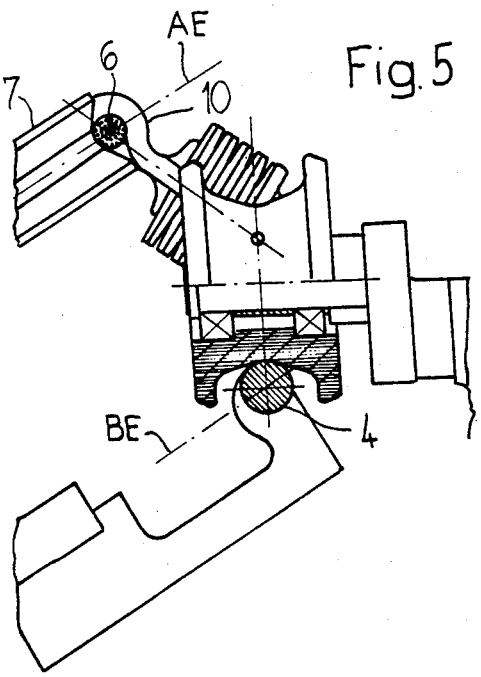
FIGS. 5 and 6 are illustrations of the roller mechanism travelling along lateral displacements to opposite sides and, at the same time, affording displacement in height, with the two views shown partly in elevation and partly in section.
Figure 6:
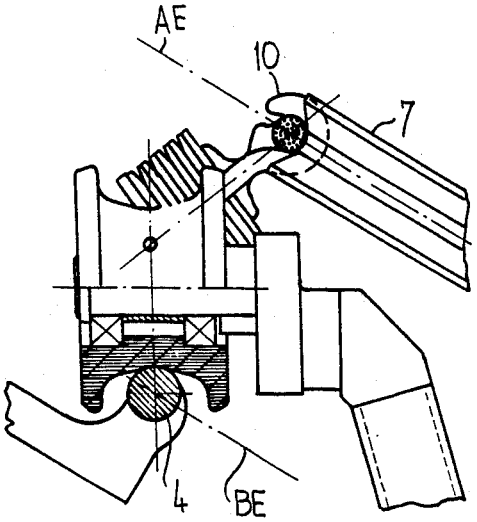

If, for instance, a cable roller or roller assembly performing an elevating function is to be made possible, then, as displayed in FIGS. 5 and 6, the radii of curvature of the guide member 1, and the pulling cable 6, can be located in transversely inclined though parallel planes AE or BE, or their centers can be located in a common transversely inclined axis. The inclination of the axis and the upright position of the roller assemblies 12 moving along a curved rail 4, cause a pivotal movement of the articulated rockers 34, corresponding to a position of the grips inclined inward with respect to the curvature. In addition, the displaceability of the grips 10 relative to the rockers 34 permit an adaptation to the changed position of the rolling mechanism or assembly 12, relative to the pulling cable 6, in the path B, with the height spacing between the pulling cable 6 and the rail 4 remaining constant.

As has already been mentioned, the grip 10 has an additional degree of freedom along the path B, in addition to its pivotability around the long travel axis L, and its displaceability in the articulated rocker 34. This degree of freedom, resulting from the displaceability of the articulated rocker 34, relative to the bearing members 28, is limited in its extent by the length of the guide aperture 39, in the sliding guide 38, and the movements in this degree of freedom can occur only counter to the action of the dampening lug 32.

Figure 4:
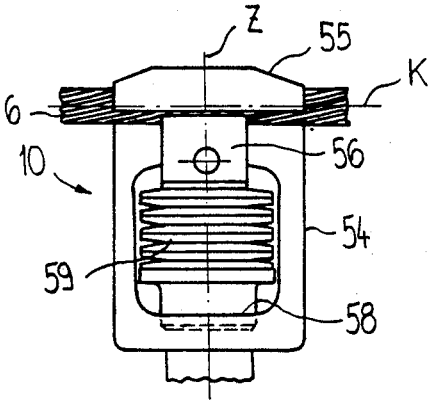
FIG. 4 is an elevational view of a grip.
Figure 7:
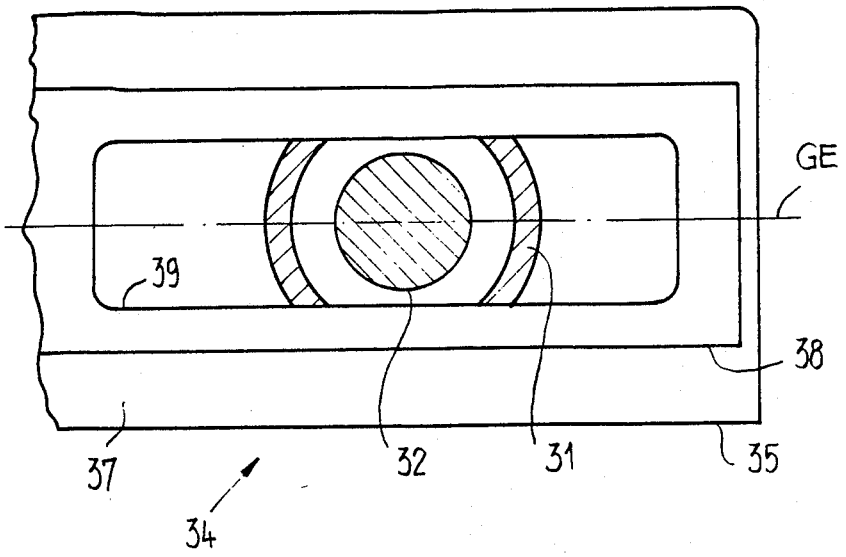
FIG. 7 is a sectional view taken along the line VII—VII in FIG. 2.

If the grip 10 has a certain length in the cable direction, as can be noted in FIG. 4, and comes into contact with the cable roller 7 during operation, then the cable roller is subjected to a sidewise displacement at its leading end and the pulling cable 6 is also lifted off the cable roller to a locally limited extent. The mobility of the articulated rocker 34 in the sliding guide 38 permits the absorption of the displacement or the movement of the grip approximately as a swivelling or pivoting movement around the axis Z, note FIG. 4. Accordingly, it is presented that the displacement is transmitted to the roller assembly 12 and, therefore, also to the car 9, and in addition this displacement causes any torsional stress in the grip itself. The dampening lugs 32 have a tendency to return the articulated rocker into the normal position as displayed in FIG. 2, and prevent any undesirable oscillating movement between the grip and the roller assembly. The described mobility of the grip, together with the articulated rocker 34, is evidently effective in the same sense if the grip runs off the cable roller 7.

While specific embodiments of the invention have been shown and described in detail to illustrate the application of the inventive principles, it will be understood that the invention may be embodied otherwise without departing from such principles.

I claim:

1. Cable haulage apparatus comprising a pulling cable, vehicles, and means for securing said vehicles to said pulling cable, wherein the improvement comprises a guide member (1) defining a course of travel of said vehicles and having a long travel axis (L), said guide member including rigid curved sections, said pulling cable (6) runs along and is spaced from said guide member, said means for securing said vehicle to said pulling cable comprising roller mechanisms (12), each including travel rollers (18) in rolling contact with said guide member along the long travel axis, each said roller mechanism including means for rigidly connecting a grip (10) to said pulling cable in the direction of the long travel axis and for displaceably connecting said grip (10) in a plane extending transversely of the long travel axis, each said grip (10) is pivotally connected to the corresponding roller mechanism (12) by an articulated rocker (34) and includes means for allowing the grip displaceable in said articulated rocker, said grip is connected to said articulated rocker (34) by two link elements (46) for pivotal movement relative to said articulated rocker, and said link elements having spaced parallel axes for effecting pivotal movement of said grip.

2. Cable haulage apparatus, as set forth in claim 1, wherein said articulated rocker (34) is U-shaped and has spaced legs (35), a bearing member (28) in engagement with each of said legs and each said bearing member having an axis coaxial with the long travel axis (L) at a roller mechanism frame (13).

3. Cable haulage apparatus, as set forth in claim 2, wherein at least one of said two link elements (46) has two link arms (47)including means for allowing pivotal engagement with said grip (10) and disposed in a fork-like relation to said grip.

4. Cable haulage apparatus, as set forth in claim 3, wherein each of said link elements has at least one said link arm (47,49) and said link arm or arms of said link elements have different lengths, and pivotal axes of said link arms at said articulated rocker (34) and said grip have different spacings from one another.

5. Cable haulage apparatus, as set forth in claim 4, wherein said articulated rocker (34) includes means for connecting it said roller mechanism frame (13) for movement transversely of the long travel axis (L).

6. Cable haulage apparatus, as set forth in claim 5, wherein said articulated rocker (34) comprises a sliding guide (38) in each of said legs extending in a long direction of said legs transversely of said long travel axis (L), each of said bearing members (28) includes means for rotatably supporting said bearing members in said articulated rocker (34) and for displaceable engaging in a different one of said sliding guides, and a dampening lug (32) formed of a material deformable in a flexually-elastic manner connects said bearing members to said legs of said articulated rocker.

7. Cable haulage apparatus, as set forth in claim 2, wherein said articulated rocker (34) is supported on said roller mechanism frame (13) between two travel rollers (18) of said roller mechanism (12) spaced apart in the direction of the long travel axis.

8. Cable haulage apparatus, as set forth in claim 1, wherein said guide member (1) is formed as a support member for said vehicles (18 )supported by said roller mechanism (12).

9. Cable haulage apparatus, as set forth in claim 1, wherein said pulling cable (6) is arranged to be laterally offset relative to said guide member, at least in the curved sections thereof.

10. Cable haulage apparatus, as set forth in claim 1, wherein said guide member (1) is formed as a rail at least in the curved sections (5) thereof.

11. Grip device for suspended vehicles in a cable haulage apparatus, including a pulling cable, and a guide member defining a course of travel of the vehicles and having a long travel axis, said grip device comprises roller mechanisms (12) each secured to the pulling cable by a grip (10), each said grip includes means for connecting said grip to one said roller mechanism in a manner for allowing adjustable movement relative thereto in a plane extending transversely of the long travel axis (L), for allowing said grip to be in adjustable spaced relation with respect to the long travel axis, and for rigidly connecting said grip with said roller mechanism in the direction of the long travel axis, said grip (10) and said roller mechanism (12) includes means for allowing them pivotally displaceable relative to said pulling cable along a path extending transversely of said long travel axis (L), said grip (10) is pivotally connected with said roller mechanism (12) by a pair of link elements (46, 48) attached to an articulated rocker (34).

12. Grip device, as set forth in claim 11, wherein said articulated rocker (34) includes means for allowing said articulated rocker pivotally displaceable around the long travel axis (L) and displaceable relative to the long travel axis.

13. A vehicle for a cable haulage apparatus having a track and a traction cable extending along said track, comprising a carriage having a longitudinal axis and having rollers for running on the track in a direction corresponding to said longitudinal axis, load suspension means depending from said carriage, clip means for dampingly engaging the traction cable and means connecting said clip means to said carriage for movement therewith, said connecting means including first bearing means connected to said carriage, first link means engaged by said first bearing means for movement relative to said carriage in a plane oriented substantially transversely of said longitudinal axis, second bearing means connected to said first link means, second link means engaged by said second bearing means for movement relative to said first link means substantially in the plane of movement thereof, said second link means carrying, wherein said first link means include a rocker engaged for pivotal movement by said first bearing means, said second link means include a pair of link members having opposite ends, said second bearing means constituting a pair of spaced apart bearing bolts, each of said link members being pivotally connected at said opposite ends to one of said bearing bolts and to said grip at spaced apart locations thereof.

14. A vehicle as claimed in claim 13, wherein said first and second bearing means each define a path of movement for said first and second link means, respectively, and wherein the path defined by said second bearing means extends substantially transversely of the path defined by said first bearing means.

* * * * *